US008861754B2

(12) United States Patent
Zhou

(10) Patent No.: US 8,861,754 B2
(45) Date of Patent: Oct. 14, 2014

(54) MOVING IRON UNIT FOR LOUDSPEAKERS

(71) Applicant: Suzhou Hearonic Electronics, Jiangsu (CN)

(72) Inventor: Wei Zhou, Suzhou (CN)

(73) Assignee: Suzhou Hearonic Electronics, Suzhou, Jiangsu (CN)

( * ) Notice: Subject to any disclaimer, the term of this patent is extended or adjusted under 35 U.S.C. 154(b) by 54 days.

(21) Appl. No.: 13/780,646

(22) Filed: Feb. 28, 2013

(65) Prior Publication Data

US 2013/0170674 A1 Jul. 4, 2013

Related U.S. Application Data

(63) Continuation of application No. PCT/CN2011/081816, filed on Nov. 4, 2011.

(30) Foreign Application Priority Data

Aug. 15, 2011 (CN) ..... 2011 1 0232849

(51) Int. Cl.

| | |
|---|---|
| ***H04R 25/00*** | (2006.01) |
| ***H04R 11/02*** | (2006.01) |
| *H04R 1/00* | (2006.01) |
| *H04R 7/18* | (2006.01) |

(52) U.S. Cl.

CPC ..... *H04R 1/00* (2013.01); *H04R 2209/022* (2013.01); *H04R 7/18* (2013.01); *H04R 11/02* (2013.01)

USPC ..... 381/162; 381/396

(58) Field of Classification Search

USPC ..... 381/150, 396, 401, 400, 412, 413, 59; 310/12.16, 12.21, 12.24, 12.27, 12.31, 310/12.33; 29/594, 602.1, 896.23

See application file for complete search history.

(56) References Cited

U.S. PATENT DOCUMENTS

| | | | | |
|---|---|---|---|---|
| 2,610,259 | A * | 9/1952 | Roverton | 381/417 |
| 2007/0108847 | A1 * | 5/2007 | Chang | 310/12 |

* cited by examiner

*Primary Examiner* — Curtis Kuntz
*Assistant Examiner* — Sunita Joshi
(74) *Attorney, Agent, or Firm* — Womble Carlyle Sandridge & Rice LLP

(57) ABSTRACT

This invention provides a moving iron unit for loudspeakers, which includes coil, iron core, diaphragm, and magnet, among which, the iron core is disposed in the coil, and the magnet is connected to the diaphragm on a transmission basis. It is characterized in that it also includes vibrating ring, to which the magnet is secured, and which is secured to the inner wall of a shielded cavity through its elastic body disposed radially, and which is connected to the diaphragm on a transmission basis through the transmission rod. Further, the unit comprises two diaphragms, which are disposed symmetrically at two sides of the vibrating ring and connected respectively to the vibrating ring on a transmission basis through a transmission rod. The coil is shaped directly by coiling on the iron core.

14 Claims, 3 Drawing Sheets

MOVING IRON UNIT FOR LOUDSPEAKERS

CROSS-REFERENCE TO RELATED APPLICATIONS

This application is a continuation application of International Patent Application No. PCT/CN2011/081816 with an international filing date of Nov. 4, 2011, designating the United States, now pending, and further claims priority benefits to Chinese Patent Application No. 201110232849.8 filed Aug. 15, 2011. The contents of all of the aforementioned applications, including any intervening amendments thereto, are incorporated herein by reference.

BACKGROUND OF THE INVENTION

1. Field of the Invention

This invention relates to a loudspeaker, particularly to a moving iron unit applied in earphone and other miniature loudspeakers, within the field of electro acoustics and micro mechanics.

2. Description of the Related Art

In the moving iron earphones in the market today, the moving iron unit works by the basic principle of electronic conversion, in which the AC signals go through the magnetic induction coil, which becomes magnetic by induction and magnetizes (polarizes) the balanced armature in the middle of the coil, and the magnetized (polarized) balanced armature vibrate up and down between two permanent magnets by the principle of "likes repel and opposites attract". The sound-generating diaphragm of the moving iron unit is changed in such a manner that a metal transmission rod is connected with the balanced armature, whose vibration up and down drives the diaphragm to vibrate up and down, thereby to boost the air in the cavity of the earphone to generate sounds. However, the existing moving iron earphone is generally troubled by shortcomings such as low conversion efficiency, insufficient high/low frequency response, low response speed, serious harmonic distortion, and susceptibility of acoustic fidelity to humidity changes. In particular, the common U-shaped, E-shaped and flat balanced armatures (refer to FIGS. 1-3), which are usually seen in market today, all have the weakness of poor mechanical shock resistance.

SUMMARY OF INVENTION

In view of the above-described problem, it is one object of the invention to provide a moving iron unit for loudspeakers, which may effectively improve the conversion efficiency of earphones and performs well against mechanical shock to overcome the weakness in the prior art.

To achieve the above objectives, in accordance with one embodiment of the invention there provided is a moving iron unit for loudspeakers, comprising a coil, a iron core, disposed in said coil; a diaphragm; and a magnet, connected to said diaphragm on a transmission basis; wherein, further comprising a vibrating ring, to which said magnet is secured, and which is secured to the inner wall of a shielded cavity through its elastic body disposed radially, and which is further connected to said diaphragm on a transmission basis through a transmission rod.

In a class of this embodiment, the moving iron unit for loudspeakers wherein, said vibrating ring is disposed coaxially with said coil and is connected to the inner wall of said shielded cavity at one side through a spring disposed radially; said magnet is secured to one side of said vibrating ring; and one side of said iron core is connected and secured to the inner wall of said shielded cavity.

In a class of this embodiment, the moving iron unit for loudspeakers, wherein, further comprising a diaphragm holder disposed on the inner wall of said shielded cavity and said diaphragm is connected and secured to the diaphragm holder.

In a class of this embodiment, the moving iron unit for loudspeakers, wherein, comprising two said diaphragms, which are symmetrically disposed at two sides of the vibrating ring and respectively connected to said vibrating ring through a transmission rod.

In a class of this embodiment, the moving iron unit for loudspeakers, wherein, said coil is shaped directly by coiling on said iron core.

In a class of this embodiment, the moving iron unit for loudspeakers, wherein, said shielded cavity is formed through a shielded shell and a shielded bottom cap being enclosed together; each of two opposite side walls of said shielded shell has a diaphragm holder disposed thereon, and two said diaphragm holders are symmetrically disposed; and one side wall between two said side walls is connected to said vibrating ring through a spring.

In a class of this embodiment, the moving iron unit for loudspeakers, wherein, both said iron core and said coil are connected and secured to said shielded bottom cap at one end.

In a class of this embodiment, the moving iron unit for loudspeakers, wherein, said vibrating ring is O-shaped.

Advantages of the invention are summarized below:

(1) As regards the defect of balanced armature in the prior art, this invention adopts the vibrating ring structure in place of the former balanced armature structure to significantly improve the product's mechanical shock resistance while keeping the product's magnetic circuit unobstructed;

(2) This invention adopts the unique diaphragm-driven structure, in which the interaction among magnet, vibrating ring and iron core can drive two diaphragms to generate sound simultaneously. Compared to the conventional one-piece diaphragm, this design helps improve conversion efficiency of products.

(3) The design of coil being directly formed on iron core, which makes the manufacture process of the whole moving iron unit simpler and more cost-effective.

In the figures, the marks and the components represented by the markets are respectively: 1-coil; 2-shielded shell; 3-shielded bottom cap; 4-iron core; 5 and 6-diaphragm; 7 and 10-diaphragm holders; 8-magnet; 9-vibrating ring; 11 and 12-transmission rods; 13-spring.

DETAILED DESCRIPTION OF THE EMBODIMENTS

Figure 1:
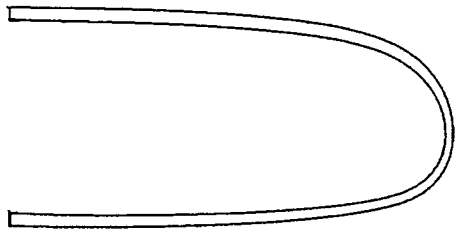
Fig.1 PRIOR ART
FIG. 1 is a structural diagram of the existing U-shaped balanced armature.
Figure 2:
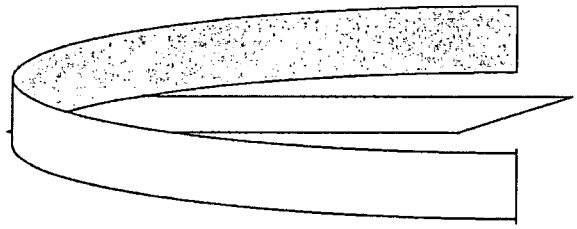
Fig.2 PRIOR ART
FIG. 2 is a structural diagram of the existing E-shaped balanced armature.
Figure 3:
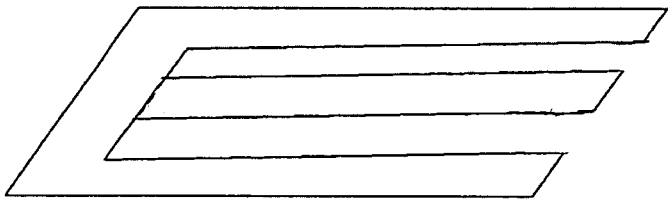
Fig.3 PRIOR ART
FIG. 3 is a structural diagram of the existing flat balanced armature.
Figure 4:
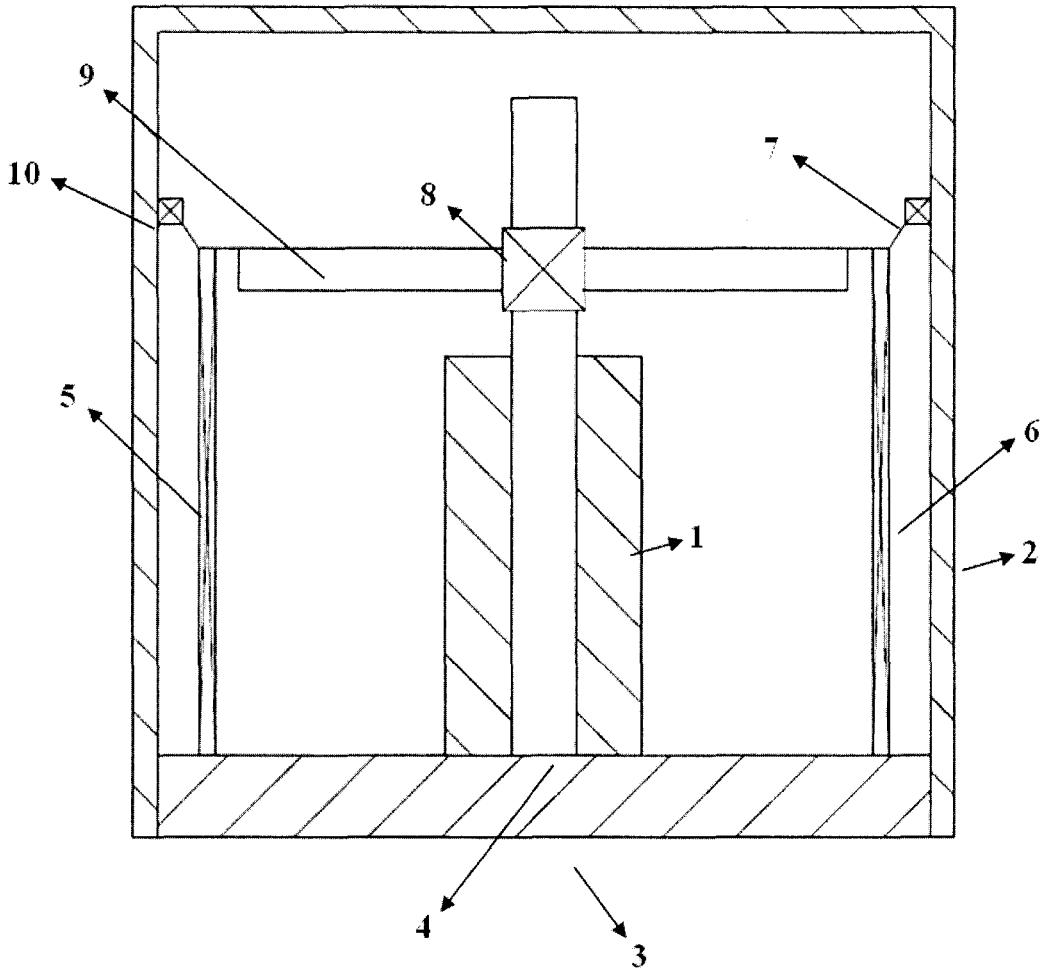
FIG. 4 is a sectional structural diagram of the moving iron unit of this invention for earphones.
Figure 5:
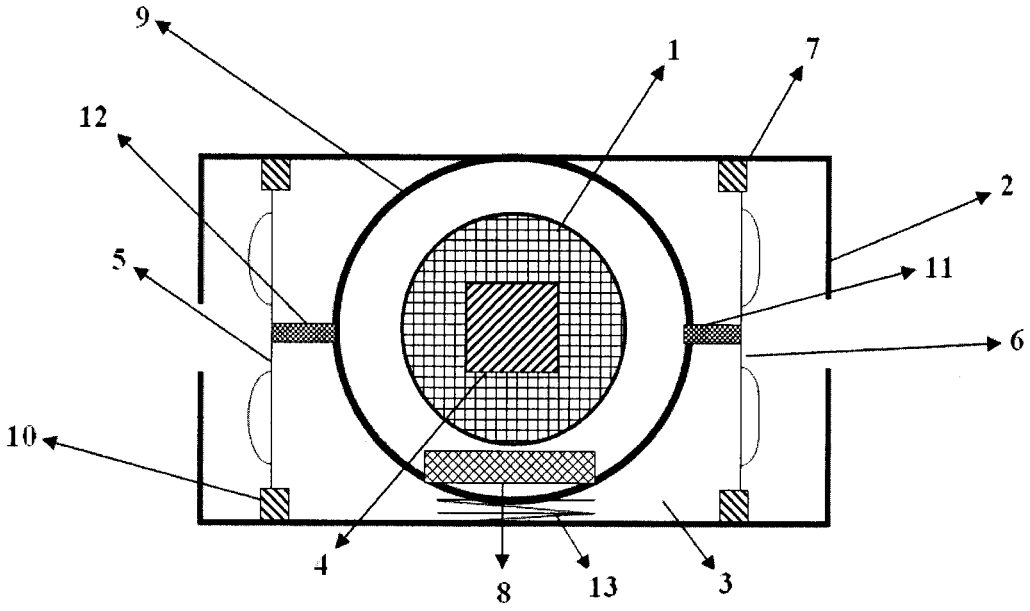
FIG. 5 is a vertical view of the moving iron unit of this invention for earphones.

One preferred embodiment of this invention in combination with the figures are provided as bellow:

Referring to FIG. 4-5, a moving iron unit for earphones, comprises a coil 1 encapsulated in a shielded cavity, an iron core 4, a diaphragm, a magnet 8, and O-shaped vibrating ring 9; the coil 1 is set on iron core 4, the magnet 8 is secured to the vibrating ring 9, and the vibrating ring 9 is secured to the inner wall of the shielded cavity through its elastic body disposed radially and is connected to the diaphragm on a transmission basis through a transmission rod.

Preferably, the magnet is secured to one side of the vibrating ring, which is disposed coaxially with the coil and is connected to the inner wall of the shielded cavity at one side through its elastic body disposed radially, and the iron core and the coil are secured and connected to the shielded cavity at one end. Preferably, there are two diaphragms 5 and 6, which are disposed symmetrically at two sides of the vibrating ring and are connected to the vibrating ring 9 respectively through transmission rods 12 and 11. Diaphragms holders 7 and 10 are disposed on the inner wall of the shielded cavity, to which diaphragms 5 and 6 are secured and connected respectively.

The shielded cavity is formed through a shielded shell 2 and a shielded bottom cap 3 being enclosed together. Each of two opposite side walls of the shielded shell has a diaphragm holder disposed thereon, and two said diaphragm holders are symmetrically disposed; and one side wall between two said side walls is connected to the vibrating ring through a spring 13.

Both the iron core and the coil are secured and connected to the shielded bottom cap at one end. Preferably, the said coil 1 is directly shaped by coiling on said iron core 4. The elastic body is preferably the spring 13.

When the moving iron unit works, the electrical signal is transmitted through the coil 1. As an effect of electro-magnetic induction, the magnetic field generated by the alternating current in coil 1 will magnetize the iron core 4, which will generate a pushing or pulling force acted on the magnet 8 secured to the vibrating ring 9 by the principle of "likes repel and opposites attract", and the vibrating ring 9 is connected to the shielded shell 2 through the spring 13. When the magnet 8 is driven, the vibrating ring 9 will be compressed or pulled as a result, thereby to drive the transmission rods 11 and 12 to move, thereby further to drive the diaphragms 5 and 6 secured to the diaphragm holders 7 and 10 to vibrate, and the vibration may drive the air to leave of the shielded shell 3 from its opening, so as to generate sound.

This invention provides an improved design of mechanical structure of balanced armature, which can significantly improve the product's mechanical shock resistance while keeping the product's magnetic circuit unobstructed. To be specific, by adopting the O-shaped vibrating ring, the horizontal and vertical mechanical shock resistance of the balanced armature is significantly enhanced, and this invention also optimizes the diaphragm drive structure in such a manner that interaction among magnet, vibrating ring and iron core can drive two diaphragms to generate sound simultaneously, significantly improving the product's conversion efficiency as compared to the conventional design with a single diaphragm.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A moving iron unit for loudspeakers, comprising:

a coil, an iron core, disposed in said coil;

a diaphragm; and a magnet, connected to said diaphragm on a transmission basis;

wherein, further comprising:

a vibrating ring, to which said magnet is secured, and which is secured to the inner wall of a shielded cavity through its elastic body disposed radially, and which is further connected to said diaphragm on a transmission basis through a transmission rod.

2. The moving iron unit for loudspeakers of claim 1, wherein, said vibrating ring is disposed coaxially with said coil and is connected to the inner wall of said shielded cavity at one side through a spring disposed radially; said magnet is secured to one side of said vibrating ring; and one side of said iron core is connected and secured to the inner wall of said shielded cavity.

3. The moving iron unit for loudspeakers of claim 1, wherein, further comprising a diaphragm holder disposed on the inner wall of said shielded cavity and said diaphragm is connected and secured to the diaphragm holder.

4. The moving iron unit for loudspeakers of claim 2, wherein, further comprising a diaphragm holder disposed on the inner wall of said shielded cavity and said diaphragm is connected and secured to the diaphragm holder.

5. The moving iron unit for loudspeakers of claim 1, wherein, comprising two said diaphragms, which are symmetrically disposed at two sides of the vibrating ring and respectively connected to said vibrating ring through transmission rods.

6. The moving iron unit for loudspeakers of claim 1, wherein, said coil is shaped directly by coiling on said iron core.

7. The moving iron unit for loudspeakers of claim 2, wherein, said coil is shaped directly by coiling on said iron core.

8. The moving iron unit for loudspeakers of claim 1, wherein, said shielded cavity is formed through a shielded shell and a shielded bottom cap being enclosed together; each of two opposite side walls of said shielded shell has a diaphragm holder disposed thereon, and two said diaphragm holders are symmetrically disposed; and one side wall between two said side walls is connected to said vibrating ring through a spring.

9. The moving iron unit for loudspeakers of claim 2, wherein, said shielded cavity is formed through a shielded shell and a shielded bottom cap being enclosed together; each of two opposite side walls of said shielded shell has a diaphragm holder disposed thereon, and two said diaphragm holders are symmetrically disposed; and one side wall between two said side walls is connected to said vibrating ring through a spring.

10. The moving iron unit for loudspeakers of claim 8, wherein, both said iron core and said coil are connected and secured to said shielded bottom cap at one end.

11. The moving iron unit for loudspeakers of claim 9, wherein, both said iron core and said coil are connected and secured to said shielded bottom cap at one end.

12. The moving iron unit for loudspeakers of claim 1, wherein, said vibrating ring is O-shaped.

13. The moving iron unit for loudspeakers of claim 2, wherein, said vibrating ring is O-shaped.

14. The moving iron unit for loudspeakers of claim 5, wherein, said vibrating ring is O-shaped.

* * * * *